US005645019A

United States Patent [19]

Liang et al.

[11] Patent Number: 5,645,019

[45] Date of Patent: Jul. 8, 1997

[54] ELECTROMECHANICALLY ACTUATED VALVE WITH SOFT LANDING AND CONSISTENT SEATING FORCE

[75] Inventors: Feng Liang, Canton; Craig Hammann Stephan, Ann Arbor, both of Mich.

[73] Assignee: Ford Global Technologies, Inc., Dearborn, Mich.

[21] Appl. No.: 747,533

[22] Filed: Nov. 12, 1996

[51] Int. Cl.[6] ..... F01L 9/04

[52] U.S. Cl. ..... 123/90.11; 251/129.01; 251/129.16; 251/129.18

[58] Field of Search ..... 123/90.11, 90.15; 251/129.01, 129.05, 129.1, 129.15, 129.16, 129.18; 335/256, 258, 266, 268

[56] References Cited

U.S. PATENT DOCUMENTS

| | | | |
|---|---|---|---|
| 4,455,543 | 6/1984 | Pischinger et al. | 335/266 |
| 4,515,343 | 5/1985 | Pischinger et al. | 123/90.11 |
| 4,682,574 | 7/1987 | Kreuter | 123/90.11 |
| 4,715,330 | 12/1987 | Buchl | 123/90.11 |
| 4,715,332 | 12/1987 | Kreuter | 123/90.11 |
| 4,719,882 | 1/1988 | Kreuter | 123/90.11 |
| 4,777,915 | 10/1988 | Bonvallet | 123/90.11 |
| 4,831,973 | 5/1989 | Richeson, Jr. | 123/90.11 |
| 5,070,826 | 12/1991 | Kawamura | 123/90.11 |
| 5,074,259 | 12/1991 | Pusic | 123/90.11 |
| 5,095,856 | 3/1992 | Kawamura | 123/90.11 |
| 5,115,772 | 5/1992 | Kawamura | 123/90.11 |
| 5,131,624 | 7/1992 | Kreuter et al. | 251/129.18 |
| 5,222,714 | 6/1993 | Morinigo et al. | 251/129.16 |

FOREIGN PATENT DOCUMENTS

1221469 A 10/1984 Russian Federation .

*Primary Examiner*—Weilun Lo
*Attorney, Agent, or Firm*—Donald A. Wilkinson

[57] ABSTRACT

An electromechanically actuated valve (12) for use as an intake or exhaust valve in an internal combustion engine. The valve (12) is actuated by a electromechanical actuator assembly (18) which includes a first electromagnet (22) and a second electromagnet (30). A disk (38) is slidably mounted to the valve (12) in a gap between the first and second electromagnets, with a pair of stops (36, 40) limiting its travel along the valve stem (15). The gap between the stops (36, 40) is large enough to allow for manufacturing tolerances and temperature changes in the assembly, with a secondary spring (56) and spring stop (54) acting to create soft landings, reducing noise and wear concerns. A first spring (48), mounted between the cylinder head (14) and disk (38), and a second spring (50), mounted between the disk (38) and an actuator housing (20), create an oscillatory system which drives most of the valve movement during engine operation, thus reducing power requirements to actuate the valves while increasing the responsiveness of the valves.

18 Claims, 2 Drawing Sheets

ELECTROMECHANICALLY ACTUATED VALVE WITH SOFT LANDING AND CONSISTENT SEATING FORCE

FIELD OF THE INVENTION

The present invention relates to electromechanically actuated valves, and more particularly to intake and exhaust valves employed in an internal combustion engine.

BACKGROUND OF THE INVENTION

Conventional engine valves (intake or exhaust) used to control the flow into and out of the cylinders of internal combustion engines, are controlled by camshafts that fix the opening and closing times of the valves relative to a crankshaft position. While this may be generally adequate, it is not optimal, since the preferred intake and exhaust valve timing varies under varying speeds and loads of the engine. Variable valve timing can account for such conditions as throttling effect at idle, EGR overlap, etc., to substantially improve overall engine performance. Although some attempts have been made to allow for variable timing based upon adjustments in the camshaft rotation, this is still limited by the individual cam lobes themselves.

Consequently, some others have attempted to do away with camshafts altogether by individually actuating the engine valves by some type of electromechanical or electrohydraulic means. These systems have not generally proven successful, however, due to substantial costs, increased noise, reduced reliability, slow response time, and/or increased energy consumption of the systems themselves.

One type of electromechanical system attempted employs simple electromagnets for actuators. But these have proven inadequate because they do not create enough magnetic force for speed needed to operate the valves without an inordinate amount of energy input. This is particularly true in light of the fact that the force profile is not desirable. The magnetic force increases as an armature disk approaches the electromagnet, causing a slap at end of stroke, creating noise and wear concerns, but not much force is available for acceleration at the beginning of the stroke, creating slow response time.

U.S. Pat. No. 5,222,714 attempts to overcome some of the deficiencies of an electromagnetic system by providing a spring to create an oscillating system about a neutral point wherein the springs are the main driving force during operation, and electromagnets provide holding forces in the opened and closed position while also making up for frictional losses of the system.

However, the system in this patent still suffers from some deficiencies not present in prior cam driven systems. For instance, since the electromagnets act on the plate, not the valve head, thermal expansion of the valve stem and manufacturing tolerances can mean that when the plate is in contact with the magnet, the valve may not be fully closed. One way to avoid this problem is for the plate to be designed so that even under the worst condition a gap remains between the magnet and plate, with a large gap at the other extreme of tolerances. To account for this possible large gap then, the current must be increased to hold the plate against the spring with the large gap, increasing energy consumption and heat of the system, and making the actual seating force unknown for any given assembly. Further, to assure closing of the engine valve head with these tolerances, the engine valve can seat with substantial velocity, resulting in unwanted noise and wear.

A consistent, known seating force is desirable for closing the engine valve in its valve seat. Further, it is also desirable for the system to take into account manufacturing tolerances and temperature variations without having to significantly increase the power consumption of the actuator.

Hence, a simple, reliable, fast yet energy efficient actuator for engine valves is also desired, with the flexibility to vary valve timing to substantially improve engine performance.

SUMMARY OF THE INVENTION

In its embodiments, the present invention contemplates an engine valve assembly for an internal combustion engine having a cylinder head. The engine valve assembly includes an engine valve having a head portion and a stem portion, adapted to be slidably mounted within the cylinder head, and an actuator housing adapted to be mounted to the cylinder head and surrounding a portion of the valve stem. A first electromagnet is fixedly mounted relative to the actuator housing, encircling a portion of the valve stem, and a second electromagnet is fixedly mounted relative to the actuator housing, encircling a portion of the valve stem farther from the head of the engine valve than the first electromagnet and spaced from the first electromagnet. A disk is slidably mounted to the engine valve stem and located between the first and second electromagnet. The engine valve assembly also includes first biasing means for biasing the disk toward the second electromagnet, second biasing means for biasing the disk toward the first electromagnet, and stop means for limiting the sliding of the disk along the valve stem toward the engine valve head to a predetermined location on the valve stem. Secondary biasing means also biases the disk toward the stop means.

Accordingly, an object of the present invention is to provide an electromechanically actuated engine valve having variable timing which is capable of operating at speeds required by internal combustion engine operation, while removing the rigid coupling between the magnetically attractable disc and valve stem of the engine valve.

An advantage of the present invention is that the electromechanical engine valve operates with minimal unwanted noise and wear created during operation by permitting a soft landing between components, including the engine valve head contact against the valve seat since the known force of the spring pulls the valve closed rather than uncontrollable electromagnetic force.

Another advantage of the present invention is that the electromechanical engine valve creates an oscillating system which traps energy in the opened or closed positions for release during transient conditions.

An additional advantage of the present invention is that the actuator allows for a consistent, selectable closing force of the engine valve head against the valve seat, regardless of changes in valve length resulting from thermal expansions or manufacturing tolerances.

DETAILED DESCRIPTION OF THE PREFERRED EMBODIMENTS

Figure 1:
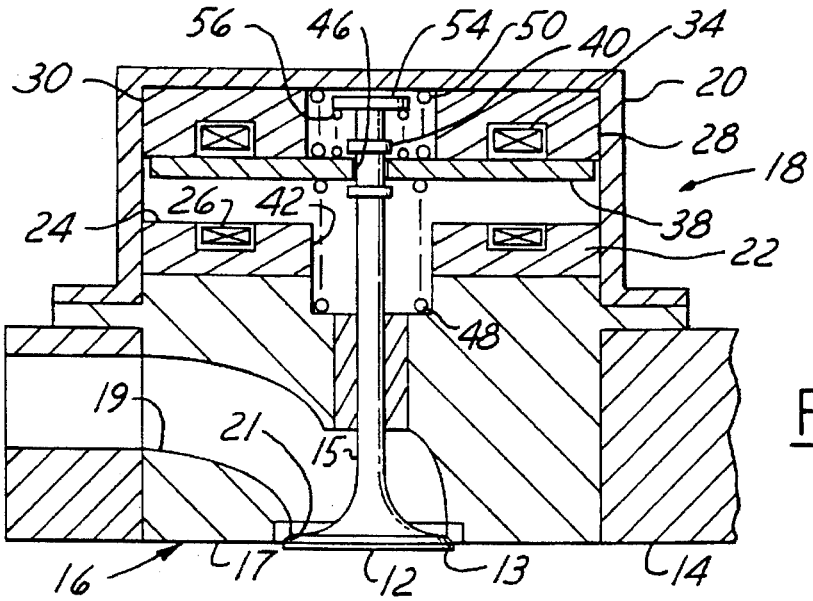
FIG. 1 is a Schematic view of an engine valve assembly mounted in an engine cylinder head, with the valve shown in a closed position, in accordance with the present invention.

FIGS. 1, and 2A–2D illustrate a first embodiment of the present invention. An engine valve 12, intake or exhaust as the case may be, is slidably mounted within an insert 17, secured in a cylinder head 14 of an internal combustion engine 16. The insert 17 and cylinder head 14 define a port 19, again either intake or exhaust, and a valve seat 21. The insert 17 allows for easier assembly of components into the cylinder head 14, and later servicing, as a module, but if preferred, the insert portion can be integral with the head.

The engine valve 12 includes a head portion 13, which seats against the valve seat 21 in its closed position, and a stem portion 15. This engine valve 12 controls the fluid flow into or out of a cylinder (not shown) within the engine 16.

An electromechanical actuator assembly 18 engages the valve stem portion 15 and drives the engine valve 12. The actuator assembly 18 includes a housing 20 mounted to the cylinder head insert 17, or cylinder head 14 if so desired. Within the housing 20 is mounted a first electromagnet 22, which is fixed relative to the housing 20. The first electromagnet 22 includes a first annulus shaped core member 24, made of a magnetically conductive material, encircling a portion of the valve stem 15. The first electromagnet 22 also includes a first coil 26, extending circumferentially through the core member 24 forming an annulus shape near the upper surface of the core member 24.

A second annulus shaped core member 28, also made of a magnetically conductive material, is fixed relative to the housing 20 and forms a part of second electromagnet 30. A second coil 34 extends circumferentially through the second core member 28 forming an annulus shape near the lower surface of the second core member 28. The two coils are connected to a conventional source of electrical current (not shown), which can be selectively turned on and off to each one independently by a conventional type of controller, such as an engine computer (not shown).

Slidably mounted about the valve stem 15 is an annular disk 38. This disk 38 is located between the upper surface of the first electromagnet 22 and the lower surface of the second electromagnet 30. Mounted on and fixed relative to the valve stem 15 are two stops, a lower stop 36 and an upper stop 40. The lower stop 36 has an outer diameter that is small enough to allow the stop 36 to slide into a circular passage 42 through the center of the first core 24. The disk 38 includes a central circular hole 46, which has a smaller diameter than the outer diameter of the lower stop 36 and upper stop 40, but a larger diameter than the valve stem 15, allowing relative sliding movement between the disk 38 and the valve stem 15 between the two stops. The sliding joint formed between the disk 38 and valve stem 15 is lubricated by the same source conventionally supplying oil to the other sliding portions of the engine valve 12.

The stops 36, 40 are located sufficiently far apart that with the valve fully closed and the disk 38 seated against the second electromagnet 30, the disk 38 is positioned between the two stops 36, 40 under substantially all conditions of temperature and manufacturing tolerances.

The upper stop 50 and spring stop 50 (discussed below) are attached after the disk 38 and secondary spring 56 are slid on. There are a number of ways of attaching the stops, well known to the art. For example, the stem 15 and stops 40, 54 can be threaded so that they are screwed on. Alternatively, welding, circlips or an interference fit are also possible. Moreover, the disk 38 could be made with a keyway, then rotated after clearing the stops.

As an alternative, the upper stop 40 can be eliminated. This alternative may work adequately depending upon the mass of the valve 12 and stiffness of the secondary spring 50, for a given engine application, which may or may not result in undesired oscillations of the valve during its transit.

A first spring 48 is mounted between the cylinder head insert 17 and the bottom surface of the disk 38, and a second spring 50 is mounted between the top surface of the disk 38 and actuator housing 20. The springs 48 and 50 are biased such that each counteracts the force of the other to cause the neutral or resting position of the engine valve 12 to be a partially opened position. This resting position occurs, for instance, when the engine 16 is not operating, and thus, the electromagnets are not activated. By having this partially open resting position, an oscillating system can be created by the two springs during engine valve operation to store some of the energy in the springs and return it to the system.

A spring stop 50 is affixed to the valve stem 15 above the upper stop 40. The disk 38 is biased toward the lower stop 36 by an additional smaller secondary spring 56 confined between the disk 38 and the spring stop 54. This spring is sized and preloaded to produce the desired holding force when the valve is closed. The spring stop 54 can be located as desired, but should be far enough above the upper stop 40 that the force of the preloaded secondary spring 56 does not vary appreciably (relative to the requirements for closing force) when the disk 38 moves between the lower stop 36 and upper stop 40.

Figure 2D:
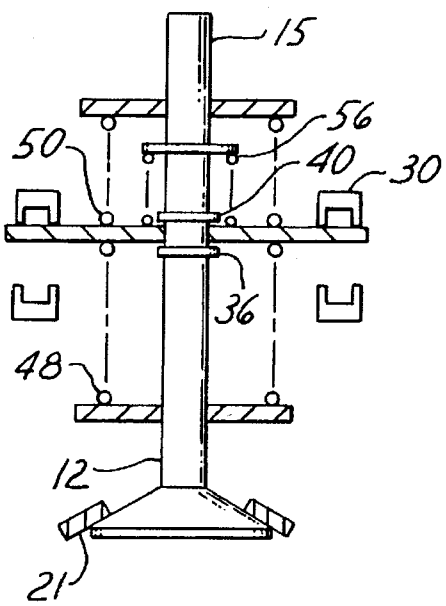
FIG. 2D is a schematic view similar to FIG. 2A, but with the valve being held in the closed position.
Figure 2C:
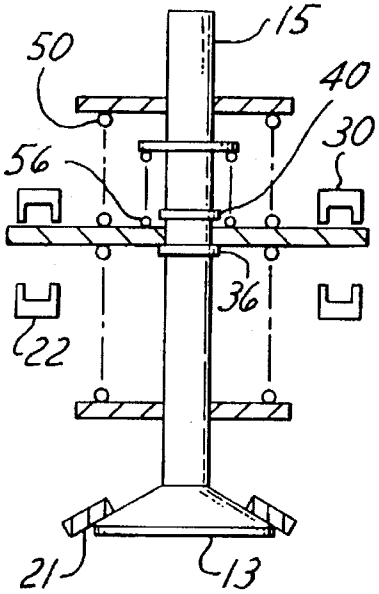
FIG. 2C is a schematic view similar to FIG. 2A, but showing the valve just contacting the valve seat.
Figure 2B:
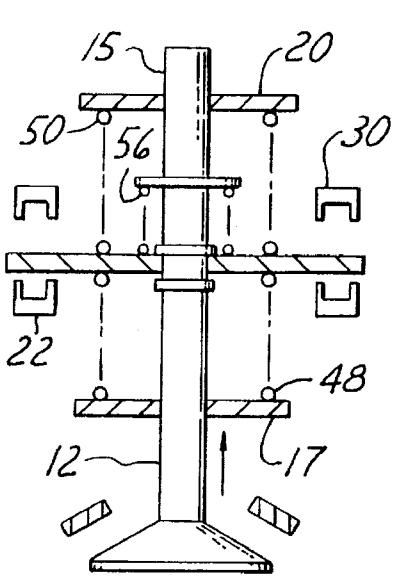
FIG. 2B is a schematic view similar to FIG. 2A, but with the valve shown in the process of closing.
Figure 2A:
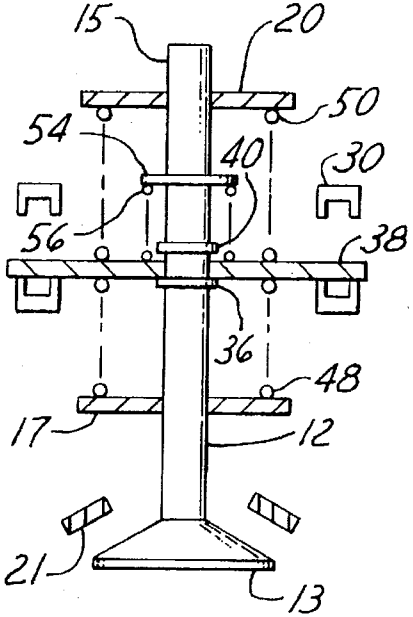
FIG. 2A is a schematic view of the engine valve assembly illustrating the valve in its opened position, in accordance with the present invention.

The operation of the electromechanical actuator 18 and resulting engine valve motion can be seen from FIGS. 2A–2D. When the engine is not in operation, the engine valve 12 rests in a neutral position, partially open. To initiate valve opening from the neutral position, the coil 26 in the first electromagnet 22 is energized, causing the disk 38 to be pulled downward towards it, compressing the first spring 48. Engine valve 12, as a result, is pulled to its open position, as is illustrated in FIG. 2A. The compressed spring 48 now stores potential energy for the oscillating system which will drive most of the engine valve movement during engine operation. The disk 38 is held in this position by the first electromagnet 22, with the secondary spring 56 biasing the valve stem 15 upward, holding the disk 38 against the lower stop 36.

In FIG. 2B, the valve is shown in the process of closing, which begins when the first electromagnet 22 is de-energized, allowing the first spring 48 to push up on the disk 38, against the force of the secondary spring 56, to the upper stop 40, accelerating the engine valve 12 upwards against the force of the second spring 50. Further, the second electromagnet 30 is energized, creating a magnetic force pulling the disk 38 upward. The engine valve 12 touches the valve seat 21 (FIG. 2C) at a low speed since the second spring 50 increasingly resists the valve motion as it is compressed. This allows the secondary spring 56 to push on the spring stop 54, moving the valve stem 15 upwards against the lower stop 36. At touchdown, the force of the second spring 50, in combination with any damping (not shown) if so desired, has brought the velocity of the valve stem 15 close to zero.

FIG. 2D illustrates the engine valve 12 being held in the closed position. With the valve head 13 against the seat 21, the attractive force of the second electromagnet 30 continues to pull the disk 38 upwards against the force of the second spring 50 and secondary spring 56. The disk 38 actually contacts the second electromagnet 30 before it can reach the upper stop 40. The force transferred to the valve stem 15 is that of the secondary spring 56. Once the contact of the disk 38 to the second electromagnet 30 is made, current through the electromagnet 30 is reduced to a low level sufficient to hold the disk 38 in this position.

The secondary spring 56 exerts a consistent, known force on the valve 12 when it is closed against its seat 21. In addition, since the second electromagnet 30 couples to the valve 12 only through the secondary spring 56, the impact of the valve head 13 on its seat 21 will be low. Further, since the disk 38 is in actual contact with one of the electromagnets in both the open and closed valve positions, the attractive magnetic field force required is maximized and so energy consumption is minimized.

To begin to open the engine valve 12, the second electromagnet 30 is de-energized, allowing the second spring 50 to push the disk 38 downward. The opening procedure, then, continues in a similar manner to the closing procedure.

The oscillating type of system described herein creates a situation where the work done by the electromagnets is mostly used to hold the valve 12 in a particular position, while most of the work of moving the valve 12 is done by the utilizing the resonance of the two opposed springs. In this way, the speed of the valve 12 is slowed at either end of its travel by the springs 48 and 50, and the kinetic energy of the valve 12, rather than being dissipated as heat upon impact at the end of the stroke, is stored as potential energy in the springs, ready to be used again. Only a small portion of the work of moving the valve 12 is done by the electromagnets, to make up for friction effects and other energy losses in the system. In this way, the energy needed to drive this electromagnetic actuator 18 is minimized.

Figure 3:
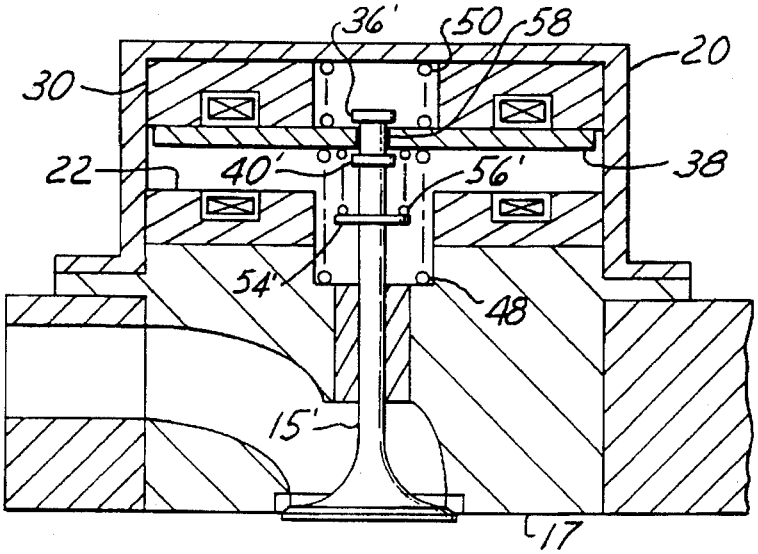
FIG. 3 is a Schematic view of an engine valve assembly similar to FIG. 1, but illustrating a second embodiment of the present invention.

A second embodiment of the present invention is illustrated in FIG. 3. In this embodiment, like elements with the first embodiment will be similarly designated, while changed elements will also be similarly designated but with an added prime. The secondary spring 56' is now located below the disk 38 and operates in tension, rather than compression, as in the first embodiment. It is fixed at one end to the disk 38 and at the other to the spring stop 54'. The valve stem 15' is again free to slide within the limits imposed by the stops 36' and 40' on the stem 15'. The upper stop 40' on the valve stem 15' can be attached by a threaded stud, or it can be threaded directly on to the stem 15'. During operation, the stem 15' is pulled into the lower stop 36' by the tensile preload of the secondary spring 56'.

Figure 4:
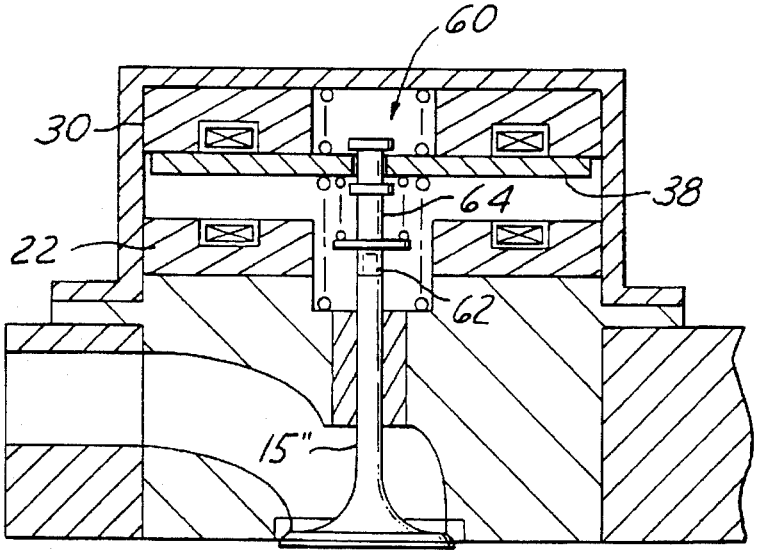
FIG. 4 is a schematic view of an engine valve assembly similar to FIG. 1, but illustrating a third embodiment of the present invention.

A third embodiment is illustrated in FIG. 4. This embodiment is also meant to aid in assembly. In this embodiment, like elements with the first embodiment will be similarly designated, while changed elements also will be similarly designated but with an added prime. It may be desirable to first assemble the spring and collar as a unit 60, acting as a valve stem extension 64, then attach it to a shorter valve stem 15" by means of a screw thread 62, adhesive bonding or other conventional procedure.

While certain embodiments of the present invention have been described in detail, those familiar with the art to which this invention relates will recognize various alternative designs and embodiments for practicing the invention as defined by the following claims.

We claim:

1. An engine valve assembly for an internal combustion engine having a cylinder head, the engine valve assembly comprising:

an engine valve having a head portion and a stem portion, adapted to be slidably mounted within the cylinder head;

an actuator housing adapted to be mounted to the cylinder head and surrounding a portion of the valve stem;

a first electromagnet, fixedly mounted relative to the actuator housing and encircling a portion of the valve stem;

a second electromagnet, fixedly mounted relative to the actuator housing and encircling a portion of the valve stem farther from the head of the engine valve than the first electromagnet and spaced from the first electromagnet;

a disk slidably mounted to the engine valve stem and located between the first and second electromagnet;

first biasing means for biasing the disk toward the second electromagnet;

second biasing means for biasing the disk toward the first electromagnet;

stop means for limiting the sliding of the disk along the valve stem toward the engine valve head to a predetermined location on the valve stem; and secondary biasing means for biasing the disk toward the stop means.

2. The engine valve assembly of claim 1 wherein the first biasing means is a spring adapted to be mounted between the disk and the cylinder head.

3. The engine valve assembly of claim 2 wherein the second biasing means is a spring mounted between the disk and the actuator housing.

4. The engine valve of claim 3 wherein the stop means further comprises limiting the sliding of the disk along the valve stem away from the engine valve head to a predetermined location on the valve stem.

5. The engine valve assembly of claim 4 wherein the stop means is a first and a second stop, each fixedly mounted to the engine valve stem, with the first stop located between the disk and the engine valve head and the second stop located on the opposite side of the disk from the first stop, with both stops shaped to limit the sliding travel of the disk along the valve stem.

6. The engine valve assembly of claim 5 wherein the secondary biasing means includes a spring stop fixedly mounted to the valve stem farther from the first stop than from the second stop and a secondary spring mounted about the valve stem between the spring stop and the disk, with the secondary spring biasing the disk toward the first stop.

7. The engine valve assembly of claim 5 wherein the secondary biasing means includes a spring stop fixedly mounted to the valve stem farther from the second stop than from the first stop and a secondary spring mounted about the valve stem between the spring stop and the disk, with the secondary spring biasing the disk toward the first stop.

8. The engine valve assembly of claim 2 wherein the stop means is a first and a second stop, each fixedly mounted to the engine valve stem, with the first stop located between the disk and the engine valve head and the second stop located on the opposite side of the disk from the first stop, with both stops shaped to limit the sliding travel of the disk along the valve stem.

9. The engine valve assembly of claim 1 wherein the second biasing means is a spring mounted between the disk and the actuator housing.

10. The engine valve assembly of claim 1 wherein the secondary biasing means includes a spring stop fixedly mounted to the valve stem farther from the engine valve head than from the disk and a secondary spring mounted about the valve stem between the spring stop and the disk, with the secondary spring biasing the disk toward the stop means.

11. The engine valve assembly of claim 8 wherein the secondary biasing means includes a spring stop fixedly mounted to the valve stem between the disk and the engine valve head and a secondary spring mounted about the valve stem between the spring stop and the disk, with the secondary spring biasing the disk toward the first stop.

12. An internal combustion engine for use in a vehicle comprising:

a cylinder head mounted to the engine;

an engine valve having a head portion and a stem portion slidably mounted within the cylinder head;

an actuator housing mounted to the cylinder head and surrounding a portion of the valve stem;

a first electromagnet, fixedly mounted relative to the actuator housing and encircling a portion of the valve stem;

a second electromagnet, fixedly mounted relative to the actuator housing and encircling a portion of the valve stem farther from the head of the engine valve than the first electromagnet and spaced from the first electromagnet;

a disk slidably mounted to the engine valve stem and located between the first and second electromagnet;

a first spring mounted between the disk and the cylinder head for biasing the disk toward the second electromagnet;

a second spring mounted between the disk and the actuator housing for biasing the disk toward the first electromagnet;

stop means for limiting the sliding of the disk along the valve stem between two predetermined locations on the valve stem; and secondary biasing means for biasing the disk toward one of the two predetermined locations.

13. The engine of claim 12 wherein the stem portion of the engine valve is comprised of two parts attached together.

14. The engine of claim 12 wherein the engine valve is an intake valve.

15. The engine of claim 12 wherein the engine valve is an exhaust valve.

16. The engine of claim 12 wherein the cylinder head comprises a valve cavity and an insert member mounted within the cavity, with the engine valve slidably mounted within the insert.

17. The engine of claim 16 wherein the stem portion of the engine valve is comprised of two parts connected together.

18. The engine valve of claim 12 wherein the stop means is a first and a second stop, each fixedly mounted to the engine valve stem, with the first stop located between the disk and the engine valve head and the second stop located on the opposite side of the disk from the first stop, with both stops shaped to limit the sliding travel of the disk along the valve stem.

* * * * *